US006964100B1

(12) United States Patent
Musland

(10) Patent No.: US 6,964,100 B1
(45) Date of Patent: Nov. 15, 2005

(54) KNIFE GUARD

(76) Inventor: Peter K. Musland, P.O. Box 1509, Edmonds, WA (US) 98020

( * ) Notice: Subject to any disclaimer, the term of this patent is extended or adjusted under 35 U.S.C. 154(b) by 50 days.

(21) Appl. No.: 10/819,005

(22) Filed: Apr. 6, 2004

(51) Int. Cl.[7] ..... B26B 29/02
(52) U.S. Cl. ..... 30/286; 151/294
(58) Field of Search ..... 30/151, 286, 294; 452/125, 132; 206/349; 224/232

(56) References Cited

U.S. PATENT DOCUMENTS

| | | | | | |
|---|---|---|---|---|---|
| 525,737 | A | * | 9/1894 | Foster | 30/286 |
| 1,593,935 | A | * | 7/1926 | Gerick et al. | 30/286 |
| 2,870,947 | A | * | 1/1959 | Hendry | 182/221 |
| 3,748,736 | A | * | 7/1973 | Eisen | 30/151 |
| 3,958,330 | A | * | 5/1976 | Hutchens | 30/151 |
| 4,263,714 | A | * | 4/1981 | Todd, Sr. | 30/151 |
| 4,290,201 | A | * | 9/1981 | Goodwin | 30/294 |
| 4,601,102 | A | * | 7/1986 | Phillips | 30/123.5 |
| 4,607,432 | A | * | 8/1986 | Montgomery | 30/294 |
| 4,707,920 | A | * | 11/1987 | Montgomery | 30/294 |
| 4,763,416 | A | * | 8/1988 | Copeland | 30/294 |
| 4,841,640 | A | | 6/1989 | Daniels | |
| 4,937,941 | A | * | 7/1990 | Crist | 30/294 |
| D352,987 | S | | 11/1994 | Stanley | |
| 5,386,635 | A | * | 2/1995 | Sheba | 30/294 |
| 5,462,479 | A | | 10/1995 | Hajek | |
| 5,581,895 | A | | 12/1996 | Jeffcoat | |
| 6,598,298 | B1 | | 7/2003 | Bartlett | |

* cited by examiner

*Primary Examiner*—Hwei-Siu C. Payer
(74) *Attorney, Agent, or Firm*—Christensen O'Connor Johnson Kindness PLLC

(57) ABSTRACT

A knife guard (100) selectively guards a tip (202) of a blade (206) of a knife (200) while exposing at least a portion of a cutting edge (208) of the blade, the knife including a handle (204) coupled to the blade. The knife guard includes a handle portion (106) for supporting the handle of the knife. The knife guard further includes a blade portion (104) coupled to the handle portion for partially receiving the blade such that at least a portion of the cutting edge is exposed. The knife guard also includes a nose portion (102) coupled to the blade portion for covering the tip of the blade.

16 Claims, 3 Drawing Sheets

KNIFE GUARD

FIELD OF THE INVENTION

This invention relates generally to guards for knives, and more particularly to knife guards that may be used by a user for field dressing an animal.

BACKGROUND OF THE INVENTION

As is well known and understood, hunting is one of the most prolific leisure time activities in many countries. Reports as early as the 1980s, for example, indicate that over three million deer are killed annually in the United States, on top of which untold thousands of elk and moose are also killed each year. Such numbers are oftentimes exceeded in other countries, such as Canada, as well. With the high cost of meat, it will well be realized how more and more each day, the meat on such animals becomes increasingly valuable. Venison on a deer, for example, is well worth between two hundred and three hundred dollars depending upon the size of the deer.

However, as will be appreciated, if it is desired to obtain such meat and to bring it home without it having a gamy taste, it becomes necessary to gut the animal as quickly as possible after the kill. One problem with doing this is that it is important to not cut the entrails or intestines of the animal while field dressing it, otherwise the waste products will spoil the meat. Further, it has been found that the fluids, such as blood, released during dressing the animal often lubricate the surfaces of the knife. This often results in injuries as the hunter's hand slips from the handle of the knife, sliding across the cutting edge of the knife.

Thus, there exists a need for a knife guard which permits the knife to cut the skin of the animal while impeding the cutting of the entrails or intestines of the animal, while also impeding injuries to the user of the knife.

SUMMARY OF THE INVENTION

One embodiment of a knife guard formed in accordance with the present invention selectively guards a tip of a blade of a knife while exposing at least a portion of a cutting edge of the blade, the knife including a handle coupled to the blade. The knife guard includes a handle portion for supporting the handle of the knife. The knife guard also includes a blade portion coupled to the handle portion for partially receiving the blade such that at least a portion of the cutting edge is exposed. The knife guard further includes a nose portion coupled to the blade portion for covering the tip of the blade.

Another embodiment of a knife guard formed in accordance with the present invention selectively guards a cutting edge and a tip of a blade of a knife. The knife guard includes a body having a channel for receiving and supporting the knife during use, the channel having a blade portion for receiving the blade of the knife and a handle portion for receiving the handle of the knife. The knife guard also includes a nose portion coupled to the body for covering the tip of the blade.

Still another embodiment of a knife guard formed in accordance with the present invention for selectively guarding a cutting edge and a tip of a blade of a knife. The knife guard includes a body adapted to receive and support the knife during use, the body having a blade portion for receiving the blade of the knife and exposing at least a portion of the cutting edge of the knife, and a handle portion for receiving the handle of the knife. The knife guard also includes a nose portion coupled to the body for covering the tip of the blade.

BRIEF DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION OF THE PREFERRED EMBODIMENT

Figure 1:
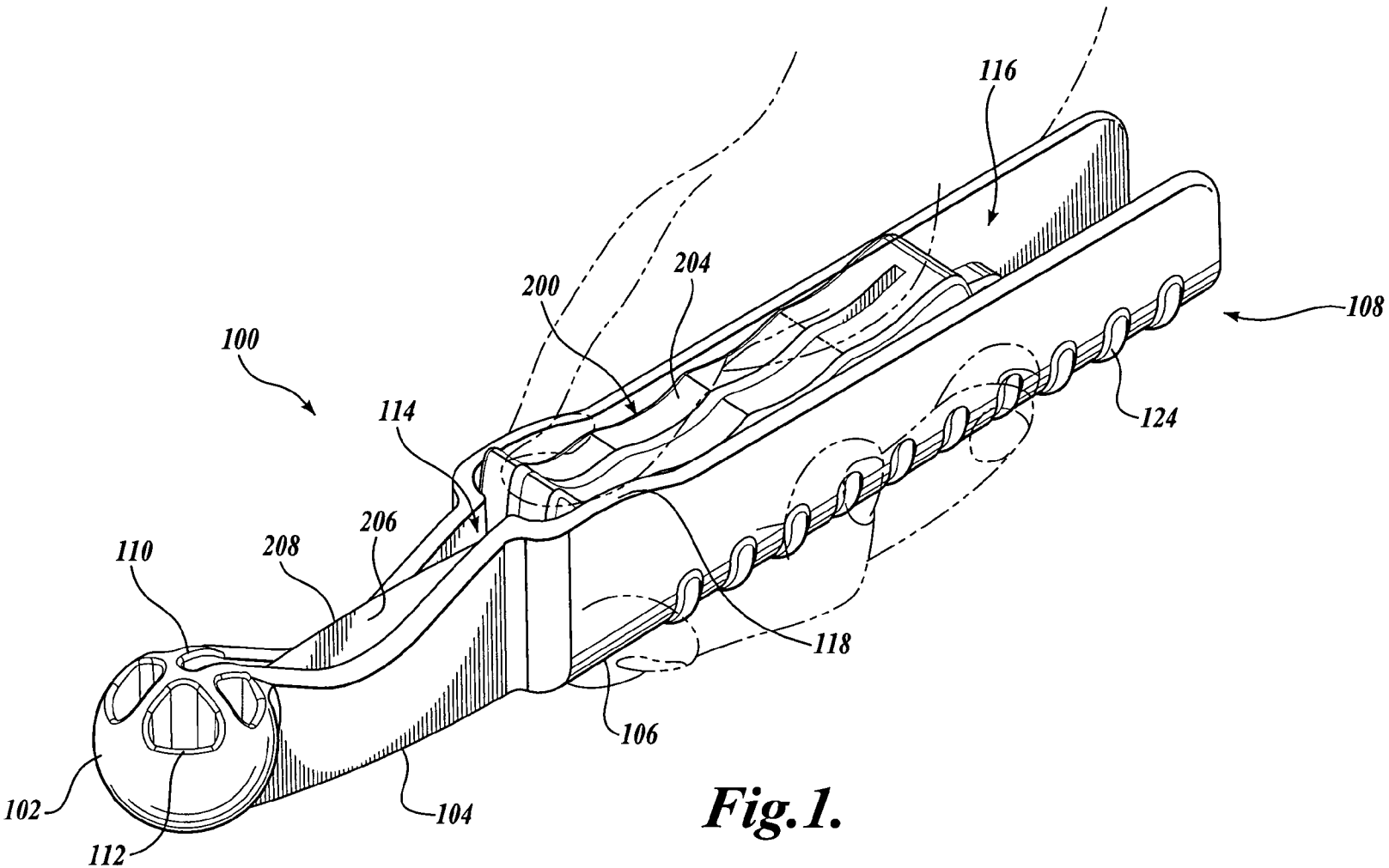
FIG. 1 is a perspective view of one embodiment of a knife guard formed in accordance with the present invention shown having received a knife and as being held by a hand of a user.
Figure 2:
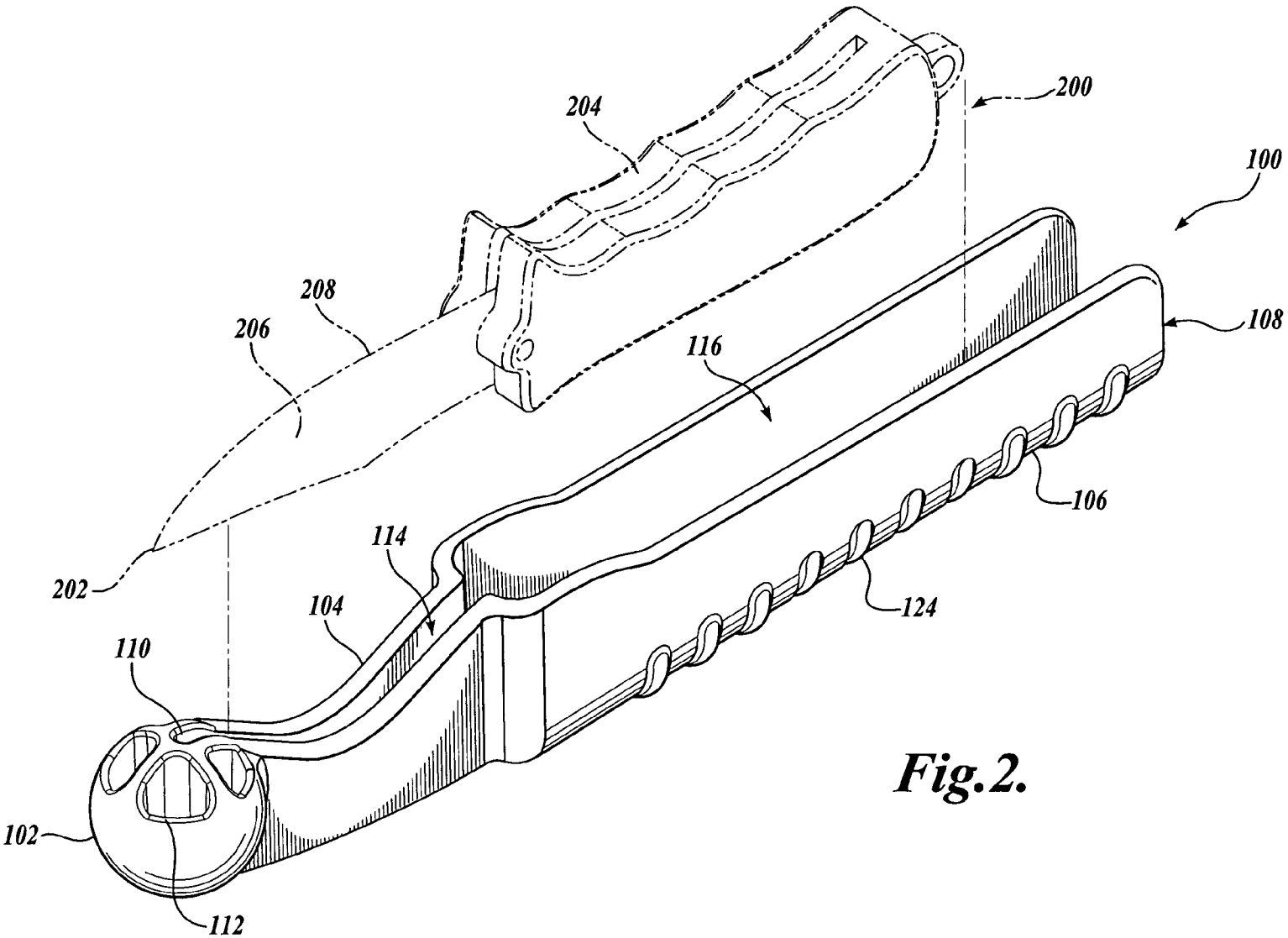
FIG. 2 is an exploded view of the knife guard and knife of FIG. 1.

Referring to FIGS. 1–4, one embodiment of a knife guard 100 formed in accordance with the present invention is depicted. Referring now to FIGS. 1 and 2, generally described, the knife guard 100 is adapted to receive and support a knife 200, such that a tip 202 of a blade 206 of the knife 200 is covered while at least a portion of a cutting edge 208 of the blade 206 is exposed.

More specifically, the knife guard 100 includes a nose portion 102 and a blade portion 104. The nose portion 102 covers the tip 202 of the blade 206 such that the tip 202 does not cut the entrails of the animal (not shown) during dressing of the animal. The blade portion 104 receives the blade 206 in such a manner that at least a portion of the cutting edge 208 of the blade 206 is exposed to cut the skin of the animal, while the nose portion 102 covers the tip 202 of the blade 206 to guard against cutting of the entrails. The knife guard 100 further includes a handle portion 106. The handle portion 106 cradles the handle 204 of the knife 200. Thus, the knife guard 100 permits the knife 200 to be securely held during the cutting of the skin of the animal while also simultaneously impeding the cutting of the entrails of the animal, thereby reducing the chance of contamination of the meat.

Still referring to FIGS. 1 and 2, this detailed description will now focus upon the structure of the knife guard 100. As mentioned above, the knife guard 100 includes the nose portion 102, blade portion 104, and handle portion 106, which collectively form a body 108 of the knife guard 100. The body 108 is preferably made of a semi-rigid or rigid material, a few suitable examples being plastic, wood, and metal, and is preferably manufactured through injection molding techniques.

The nose portion 102 is adapted to receive the tip 202 of the blade 206 within a slot 110 in the nose portion 102. The nose portion 102 is blunt shaped so as to slide along a surface without damaging the surface. The blunt shape of the nose portion 102 allows the nose portion 102 to slide along the entrails of the animal without cutting the entrails. In the illustrated embodiment, the nose portion 102 is substantially spherical in shape. The nose portion 102 includes several voids 112 used to reduce the amount of material used in forming the nose portion 102 and to lighten the knife guard 100. Although the nose portion 102 is depicted and described as spherical in shape, it should be apparent to those skilled in the art that the nose portion 102 may be shaped in other suitable shapes, a few suitable examples being conical, frustoconical, oval, and convex, without departing from the spirit and scope of the present invention.

Still referring to FIGS. 1 and 2, the blade portion 104 will now be described. The blade portion 104 extends between the nose portion 102 and the handle portion 106. The blade portion 104 includes a channel 114 disposed along the length of the blade portion 104. The width of the channel 114 is selected to receive the blade 206 of the knife 200. Preferably, the width of the channel 114 is selected to be just slightly wider than the width of the blade 206 to permit the blade 206 to be received easily within the channel 114 but still provide some support to the blade 206 to impede the blade from tilting.

Figure 3:
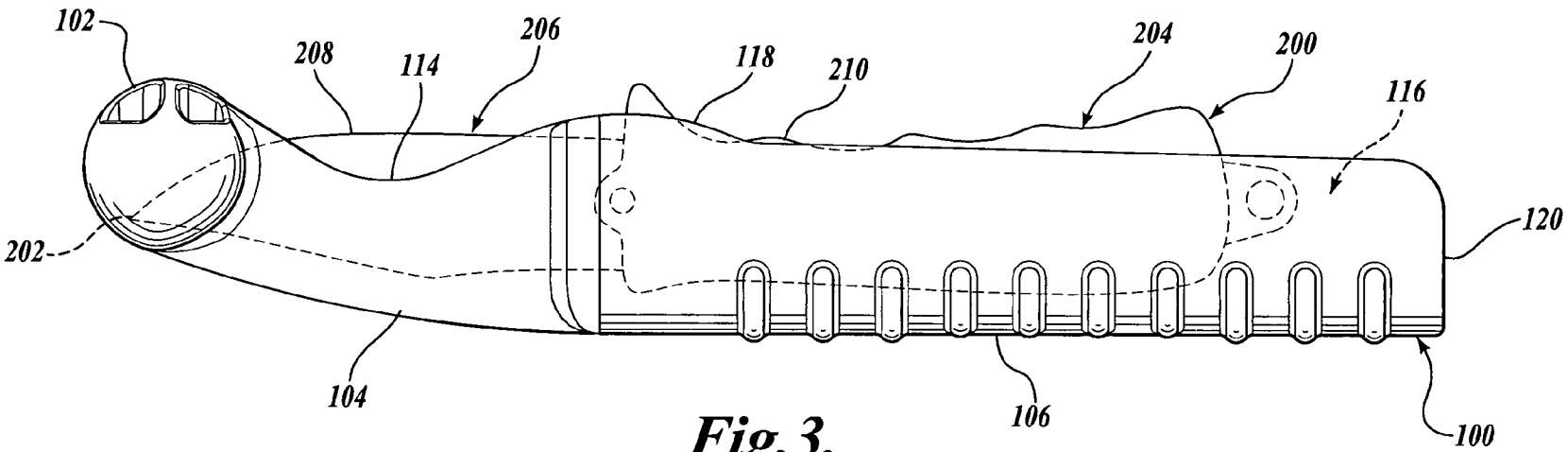
FIG. 3 is a side elevation view of the knife guard and knife of FIG. 1.

Referring to FIG. 3, the height of the channel 114 may vary to selectively expose the cutting edge 208 of the knife 200. In the illustrated embodiment, the height of the channel 114 is varied such that the channel 114 extends above the height of the cutting edge 208 near the tip 202 of the blade 206 and again at the rear end of the cutting edge 208, where the channel 114 meets the handle portion 106. The height of the channel 114 dips down between these points to expose the cutting edge 208 therebetween.

Referring to FIGS. 1 and 2, the handle portion 106 will now be described. The handle portion 106 is adapted to receive the handle 204 of the knife 200. The handle portion 106 extends aft of the blade portion 104. An exterior surface of the handle portion 106 may include a plurality of protrusions 124, as shown, for increasing a user's grip on the handle portion 106.

The handle portion 106 includes a channel 116 disposed along a length of the handle portion 106. The width of the channel 116 is selected to receive the handle 204 of the knife 200. Preferably, the width of the channel 116 is selected to be just slightly wider than the width of the handle 204 to permit the handle 204 to be received easily within the channel 116 but still provide some support to the handle 204 to impede the handle from tilting.

Referring to FIG. 3, the height of the channel 116 may vary. The height of the channel 116 along a majority of the length of the channel 116 is preferably selected so that at least a portion of the handle 204, such as the griping ridges 210 of the handle 204, extend above the channel 116. Thus, when a user wraps his/her hand around the knife guard 100 with a knife 200 received therein, the hand contacts both the knife guard 100 and the knife 200 simultaneously such that the user is able to press the two together. This helps to prevent the knife 200 from moving within the knife guard 100.

In the illustrated embodiment, the height of the channel 116 increases towards the forward end of the handle 204. The raising of the height of the channel 116 in this region preferably forms a thumb stop 118. The thumb stop 118 is adapted to engage the thumb of the user during use, and is used to help impede the thumb of the user from slipping forward and contacting the cutting blade 206 of the knife 200. The channel 116 preferably has an open end 120, best seen in FIG. 4. The open end 120 permits knife handles of longer length to be received within the channel 116.

Figure 4:
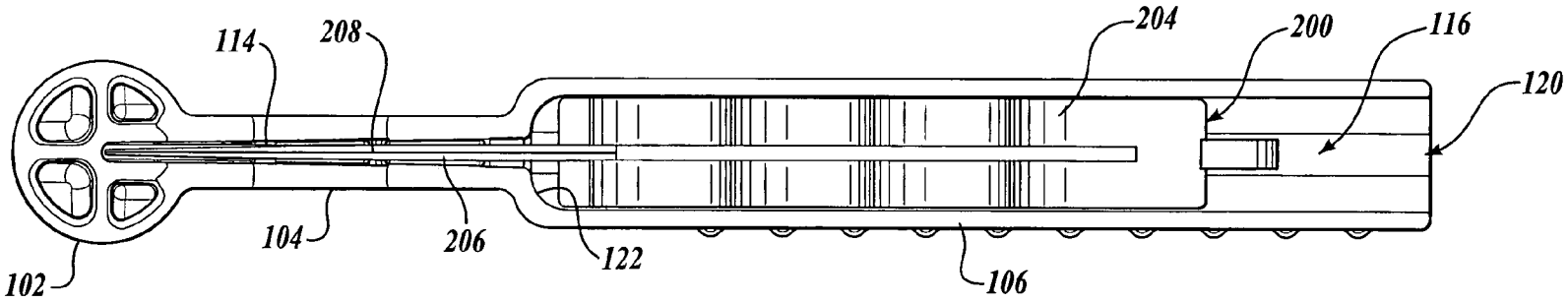
FIG. 4 is a top view of the knife guard of FIG. 1.

Referring now to FIG. 4, the channel 116 ends at its forward end at a shoulder 122. The shoulder 122 is formed at the meeting of the channel 114 of the blade portion 104 with the channel 116 of the handle portion 106. The width of the channel 114 of the blade portion 104 is less than the width of the channel 116 of the handle portion 106, thereby forming a shoulder 122 for engaging the handle 204 of the knife 200. The shoulder 122 impedes movement of the knife 200 in the direction of the blade 206.

In light of the above description of the structure of the knife guard 100, the operation of the knife guard 100 will now be discussed. Referring to FIG. 1, the knife guard 100 may be used to field dress an animal. The knife guard 100 is adapted to receive most any hunting knife 200. The knife 200 is inserted cutting edge 208 up, with the tip of the blade 206 inserted in the nose portion 102. The handle 204 of the knife 200 rests in the trough or channel 116 of the handle portion 106. Using a firm grip on the handle portion 106 of the knife guard 100, the nose portion 102 is inserted within a small incision made at the base of the belly just ahead of the pelvic bone of the animal (not shown). The knife guard 100 and accompanying knife 200 are pushed forward, slicing the animal open to the brisket. The nose portion 102 slides past the entrails of the animal, substantially reducing the chance of the entrails becoming punctured.

While the preferred embodiment of the invention has been illustrated and described, it will be appreciated that various changes can be made therein without departing from the spirit and scope of the invention.

What is claimed is:

1. A knife guard for selectively guarding a tip of a blade of a knife while exposing at least a portion of a cutting edge of the blade, the knife including a handle coupled to the blade, the knife guard comprising:

(a) a handle portion for supporting the handle of the knife when the knife is placed in the knife guard;

(b) a blade portion coupled to the handle portion for partially receiving the blade, wherein the blade portion includes a channel having a forward end, a rear end, and a middle portion extending between the forward and rear ends, wherein a height of the middle portion is less than a height of the forward end and a height of the rear end such that when the knife is placed in the knife guard with the cutting edge exposed, the forward and rear ends of the channel extend above the cutting edge and the middle portion is disposed below the cutting edge to expose at least a portion of the cutting edge; and (c) a nose portion coupled to the forward end of the blade portion for covering the tip of the blade.

2. The knife guard of claim 1, wherein the handle portion, the blade portion, and the nose portion are rigidly coupled to one another.

3. The knife guard of claim 1, wherein the nose portion is substantially bulbous in shape.

4. The knife guard of claim 1, wherein the handle portion includes a channel for receiving and supporting the handle of the knife.

5. The knife guard of claim 4, wherein the channel of the blade portion opens into the channel of the handle portion.

6. The knife guard of claim 5, wherein a width of the channel of the blade portion is less than a width of the channel of the handle portion, thereby forming a shoulder for engaging the handle of the knife where the blade portion opens into the channel of the handle portion to impede movement of the knife in the direction of the blade.

7. The knife guard of claim 1, wherein an exterior surface of the handle portion includes a plurality of protrusions for increasing a user's grip on the handle portion.

8. The knife guard of claim 1, wherein the handle portion, the blade portion, and the nose portion are adapted to removably receive the knife such that the knife can be removed and replaced with another differently shaped knife.

9. A knife guard for selectively guarding a cutting edge and a tip of a blade of a knife, the knife including a handle coupled to a base of the blade, the knife guard comprising:

(a) a body having a channel for receiving and supporting the knife during use, the channel having a blade portion for receiving the blade of the knife, wherein a height of the channel varies such that a height of a middle portion of the channel extends below a height of a forward end of the channel and a height of a rear end of the channel such that when the channel receives the blade the height of the channel extends above a height of the blade near the tip of the blade and near the base of the blade and is disposed below the height of the blade near a middle portion of the blade to expose at least a portion of the cutting edge of the knife, and a handle portion for receiving the handle of the knife; and (b) a nose portion coupled to the body for covering the tip of the blade.

10. The knife guard of claim 9, wherein the nose portion is substantially bulbous in shape.

11. The knife guard of claim 9, wherein a width of the channel of the blade portion is less than a width of the channel of the handle portion, thereby forming a shoulder for engaging the handle of the knife to impede movement of the knife in the direction of the blade.

12. The knife guard of claim 9, wherein the body is rigid and wherein the nose portion is rigidly coupled to the body.

13. The knife guard of claim 9, wherein an exterior surface of the body includes a plurality of protrusions disposed on the handle portion for increasing a user's grip on the body.

14. The knife guard of claim 9, wherein the body and the nose portion are adapted to removably receive the knife such that the knife can be removed and replaced with another differently shaped knife.

15. A method for selectively guarding a tip of a blade of a knife while exposing at least a portion of a cutting edge of the blade using a knife guard, the knife guard having a handle portion for receiving a handle of the knife, a blade portion coupled to the handle portion for receiving at least a portion of the blade, wherein the blade portion includes a channel having a forward end, a rear end, and a middle portion extending between the forward and rear ends, wherein a height of the channel varies between the forward and rear ends, and a nose portion coupled to the blade portion for guarding the tip of the blade, the method comprising:

placing the knife in the knife guard so that the handle of the knife is received within the handle portion and the blade of the knife is received by the blade portion with the forward and rear ends of the channel extending above the cutting edge and the middle portion disposed below the cutting edge to expose at least a portion of the cutting edge, and such that the nose portion covers the tip of the blade.

16. The method of claim 14, further comprising removing the knife from the knife guard.

* * * * *

UNITED STATES PATENT AND TRADEMARK OFFICE

CERTIFICATE OF CORRECTION

PATENT NO. : 6,964,100 B1
DATED : November 15, 2005
INVENTOR(S) : P.K. Musland

It is certified that error appears in the above-identified patent and that said Letters Patent is hereby corrected as shown below:

Column 5,
Line 10, "receives the blade the" should read -- receives the blade, the --.

Column 6,
Line 28, "claim 14," should read -- claim 15, --.

Signed and Sealed this

Twenty-eighth Day of March, 2006

JON W. DUDAS
*Director of the United States Patent and Trademark Office*